US006226977B1

(12) United States Patent
Ichiryu et al.

(10) Patent No.: US 6,226,977 B1
(45) Date of Patent: May 8, 2001

(54) BYPASS AIR VOLUME CONTROL DEVICE FOR COMBUSTOR USED IN GAS TURBINE

(75) Inventors: Taku Ichiryu; Tadao Yashiki, both of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/381,470

(22) PCT Filed: Jan. 26, 1998

(86) PCT No.: PCT/JP98/00276

§ 371 Date: Sep. 21, 1999

§ 102(e) Date: Sep. 21, 1999

(87) PCT Pub. No.: WO99/37954

PCT Pub. Date: Jul. 29, 1999

(51) Int. Cl.[7] ..... F02C 9/00
(52) U.S. Cl. ..... 60/39.23
(58) Field of Search ..... 60/39.23

(56) References Cited

U.S. PATENT DOCUMENTS 4,785,624 * 11/1988 Smith et al. ..... 60/39.75

FOREIGN PATENT DOCUMENTS 57-150373 9/1982 (JP) .
57-150373 U * 9/1982 (JP) .
60-128164 8/1985 (JP) .
61-161543 10/1986 (JP) .
5-52125 3/1993 (JP) .

* cited by examiner

*Primary Examiner*—Charles G. Freay
*Assistant Examiner*—Ehud Gartenberg
(74) *Attorney, Agent, or Firm*—Evenson, McKeown, Edwards & Lenahan, P.L.L.C.

(57) ABSTRACT

The invention applies to an air bypass control device which can bypass a portion of the compressed air in the space within the casing into the tail pipe connected to a combustion chamber via a control valve and a bypass channel. The invention includes a valve mechanism including a flat sliding ring, and a valve operating mechanism. The valve mechanism intersects a number of bypass air channels each of which is connected to a pipe located in the space inside the casing. A number of openings are arranged in the flat sliding ring for bypassing the air to the bypass air channels. The valve operating mechanism, one end of which is connected to the flat sliding ring, causes the flat sliding ring to rotate back and forth. When the operating mechanism rotates the flat sliding ring, the openings in the flat sliding ring rotate so as to coincide with or move away from the openings of the bypass channels. The control valve mechanism is made up of a flat sliding ring with a number of openings which corresponds to the number of bypass channels, and a ring supporting base which supports the flat sliding ring in such a way that the flat sliding ring can slide freely in the circumferential direction. One side of the openings of the flat sliding ring opens into the space in the casing, and the other side of the openings opens into the opening of the bypass channel when it is rotated.

3 Claims, 6 Drawing Sheets

BYPASS AIR VOLUME CONTROL DEVICE FOR COMBUSTOR USED IN GAS TURBINE

TECHNICAL FIELD

This invention concerns a bypass air control device used to control the volume of air bypassed from the combustion engine in a gas turbine. More specifically, it concerns a bypass air control device which bypasses a volume of compressed air in the casing of the combustion engine, in which a number of combustion chambers are arranged with tail pipes, by diverting the compressed air into those tail pipes.

TECHNICAL BACKGROUND

The gas turbines used in electric power plants, nuclear power plants and various other industrial plants are velocity-type heat engines which employ as their operating medium their own operating gases, mainly air and combustion gases. These turbines basically comprise a compressor, which performs the adiabatic compression process; a combustor, which heats the air-fuel mixture under constant pressure; and a turbine, which performs the adiabatic expansion process.

The combustor has a number of combustion chambers, each with a tail pipe, in the space in the casing which is pressurized by the air from the compressor. The combustion gases generated in the combustion chambers are conducted via the tail pipes to the turbine, which they cause to rotate.

In this sort of combustor, the air pressurized by the compressor is conducted to the space in the combustor casing at all times. Since the amount of the pressured air for combustion is proportional to the state of combustion in the chambers (i.e., to the load fluctuation), and it fluctuates according to the state of combustion at all times, it is necessary to bypass the pressurized air in the space in the casing in order to maintain the air pressure at a constant level. In other words, a portion of the compressed air in the space is conducted via control valves or bypass channels into the tail pipes connected to the combustion chambers, mixed with the hot, high-pressure combustion gases in the pipes and released into the turbine, thus the pressure of the air in the space in the casing can be maintained at a constant level.

To be more specific, if the volume of air admitted to the bypass channels is controlled by a valve or a valve-adjusting mechanism, and a large volume of pressurized air is to be admitted to the combustion chamber, then the bypass valve can be constricted or closed by the valve-adjusting mechanism so that the volume of air flowing into the bypass channels is reduced or entirely cut off. If a small volume of pressurized air is to be admitted to the combustion chamber, the bypass valve can be opened more or opened all the way so that the volume of air flowing into the bypass channels is increased. In this way the air in the space in the casing can be maintained at a specified pressure.

The prior art design shown in FIG. 7 is a bypass air control device for controlling the volume of air which is bypassed. It consists of a control valve for the bypass channel and a mechanism for adjusting the valve.

4 is the pressurized space inside casing 7 of the combustor. In the space 4 under casing 7, a number of the combustion chambers (not shown) and the tail pipes 1 which are connected to them are arranged around the circumference of the casing. (In the drawing, only casing 7 and the essential portion of a single tail pipe 1 are shown.)

A bypass channel consisting of elbow pipe 3 and bypass pipe 2 is connected to the side of the tail pipe 1. Opening 2*a* at the front of the bypass channel faces space 4 in casing 7. Pressurized air can be bypassed into the tail pipe 1 via the opening 2*a*. A butterfly valve 5 is inside the bypass pipe 2. This valve controls the volume of air which is bypassed. Valve stem 19 of the butterfly valve 5 extends upward from the valve and is connected via a spline to adjustment shaft 17.

Shaft 17 is mounted to the outer surface of casing 7. Its operating portion is inserted through casing 7; its front end is connected via a spline to valve stem 19 of the butterfly valve 5.

Annular inner ring 9 is fixed on the outer periphery of the exterior (i.e., the upper surface) of the casing 7. The upper surface of the inner ring 9 is shaped into a rectangular depression. Shaft rollers 9*a* are mounted along the entire periphery of inner ring 9, so that outer ring 11 can freely move in contact with them in the bottom of the depression.

The bottom of outer ring 11 has a rectangular protuberance which engages in the shaft rollers in the inner ring 9 in such a way that it is free to rotate. The inner surface of the outer ring 11 and the upper end of adjustment shaft 17 are connected by link 13 and lever 15, which convert the rotational movement of the outer ring 11 to rotational movement of adjustment shaft 17.

Thus when outer ring 11 rotates in the peripheral direction with inner ring 9 as a guide, adjustment shaft 17 is caused to rotate via link 13 and lever 15.

Because adjustment shaft 17 is connected to valve stem 19 of butterfly valve 5 via a spline, the rotation of shaft 17 is linked to the rotation of valve stem 19, and valve body 21 of valve 5 can be made to open and close.

Thus the rotation in of outer ring 11 the circumferential direction on the outer surface of the casing 7 can be converted to a force which drives valve body 21 of butterfly valve 5 in bypass channel 2 and 3 within casing 7 to open or close. In this way it is possible to adjust the rate at which the air bypass control valve is opened, and with it, the volume of air which is bypassed.

In this sort of prior art air bypass device for controlling the volume of air, valve body 21 of butterfly valve 5 is made of a lightweight material, so vibration resulting from combustion could be transmitted via the tail pipe from the combustion chamber to the bypass channel. When this happened, the resonant vibration of the pipe would cause the valve body in the channel to stutter. This would result in greatly accelerated abrasion of the valve body, the shaft and the bearings for the valve stem in the bypass channel.

DESCRIPTION OF THE INVENTION

The object of this invention is to provide a bypass air control device for controlling the volume of air bypassed used in the combustion engine of a gas turbine in which, even when the combustion vibration described above occurs, the structural components of the control valve and its related hardware would not experience vibration, and in which the opening and closing of the bypass could be controlled in a reliable and stable fashion.

Another object of this invention is to provide a bypass air control device for controlling the volume of air bypassed in which the links or other connectors between the valve in the bypass channel for controlling the volume of air and the mechanism for adjusting that valve, which is placed on the exterior surface of the casing, can easily absorb any thermal expansion or assembly error which might occur.

Still other objects of this invention will be made clear from the disclosure which follows.

To achieve these objects, the present invention has been designed as follows. It pertains to a combustion engine for a gas turbine which has, in a space within the casing pressurized by compressed air fed into it from a compressor, a number of combustors comprised of combustion chambers and the tail pipes connected to them. The invention applies to an air bypass control device which can bypass a portion of the compressed air in the space within the casing into the tail pipe connected to a combustion chamber via a control valve and a bypass channel.

The invention is distinguished in the following ways, it comprises a valve mechanism including a flat sliding ring, and a valve operating mechanism. The valve mechanism intersects a number of bypass air channels, each of which is connected to a pipe located in the space inside the casing. The bypass air channels are located at a circular position in the casing. A number of openings are arranged in the flat sliding ring of the valve mechanism corresponding to the number of bypass air channels for bypassing the air to the bypass air channels. The valve operating mechanism for the valve, one end of which is connected to the flat sliding ring, causes the flat sliding ring to rotate back and forth in the circumferential direction.

When the valve operating mechanism rotates the flat sliding ring through a certain angle, the openings in the flat sliding ring rotate so as to coincide with or move away from the openings of the bypass channels. In this way it is possible to control the area of the openings of the bypass channels.

The control valve mechanism comprises a flat sliding ring with a number of openings which corresponds to the number of bypass channels, and a ring supporting base which supports the flat sliding ring in such a way that the flat sliding ring can slide freely in the circumferential direction. One side of the openings of the flat sliding ring opens into the space in the casing, and the other side of the openings opens into the opening of the bypass channel when it is rotated. A portion of the compressed air from the pressurized air space in the casing can be conducted through the ring openings into the openings of the bypass channels.

With this invention, then, there is no longer a control valve for each of a number of bypass channels, which number corresponds to the number of tail pipes which are in the space in the casing of the combustion engine. Rather, there are only one or two control valves for all of the bypass channels. (As shall be explained in the embodiments which follow, the basic design calls for a single valve. However, two of the flat sliding rings described above may be laid one atop the other in a concentric fashion, with one serving as the valve for the odd-numbered bypass channels and the other as the valve for the even-numbered channels.) A number of bypass channels can thus be controlled by one or a few flat sliding rings which slide over the openings of the bypass channels, and one or several valve operating mechanisms will suffice. This is a much simpler configuration than is used in the prior art, and it allows the parts count to be greatly reduced.

Furthermore, because the flat sliding rings do not control the bypass channels individually, but globally, any vibration generated by combustion which is transmitted via the tail pipes will tend to be mutually cancelled. Even if it is not, the self-induced vibration of the rings will be substantially mitigated because they are much more massive than butterfly valves.

The fact that self-induced vibration is substantially eliminated means that components which experience friction will abrade more slowly; and since the frictional parts are not shafts, but a flat sliding ring which contacts the entire surface, only minimal abrasion will occur.

The flat sliding ring is not pivoted on an axis like the butterfly valves in prior art devices. Rather, it is a large-diameter ring which covers all of a number of bypass channels (16 in the embodiments which follow) placed at the periphery of the space in a cylindrical casing. The operating mechanism for the flat sliding ring is connected to one side (say, on the outside) of the ring, so the angular rotation of the flat sliding ring can be shorter than the travel of the operating mechanism. This enables the flow to be controlled more accurately.

As the following embodiments will show, the valve operating mechanism discussed above may consist of links or gear mechanisms.

DESCRIPTION OF PREFERRED EMBODIMENTS

In the following section a detailed explanation of this invention will be given with reference to the drawings. To the extent that the dimensions, materials, shape and relative position of the components described in this embodiment are not definitely fixed, the scope of the invention is not limited to those specified, which are meant to serve merely as illustrative examples.

Figure 1:
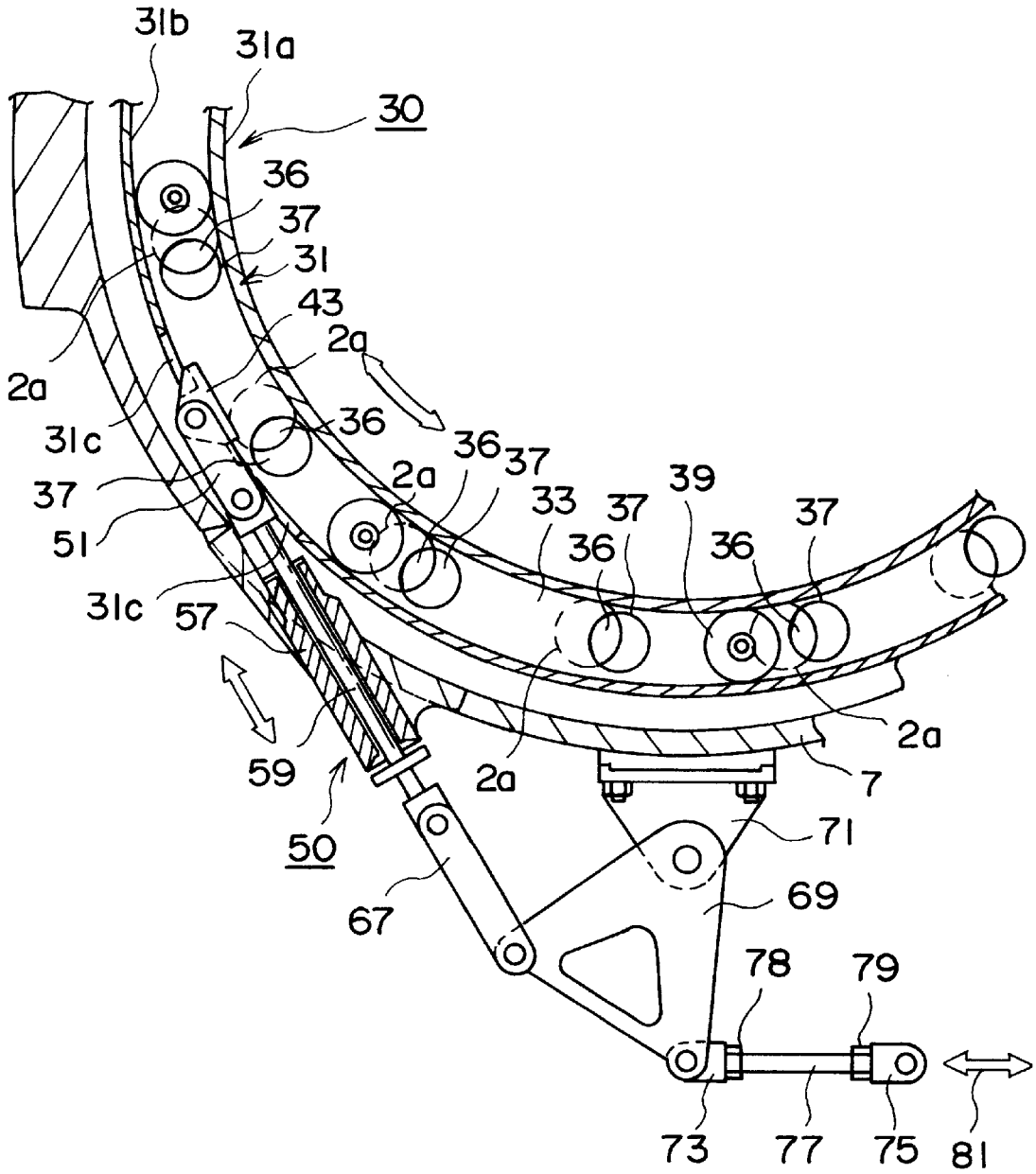
FIG. 1 is a side view of the essential parts of a bypass air control device which is a preferred embodiment of this invention for controlling the volume of air bypassed.
Figure 2:
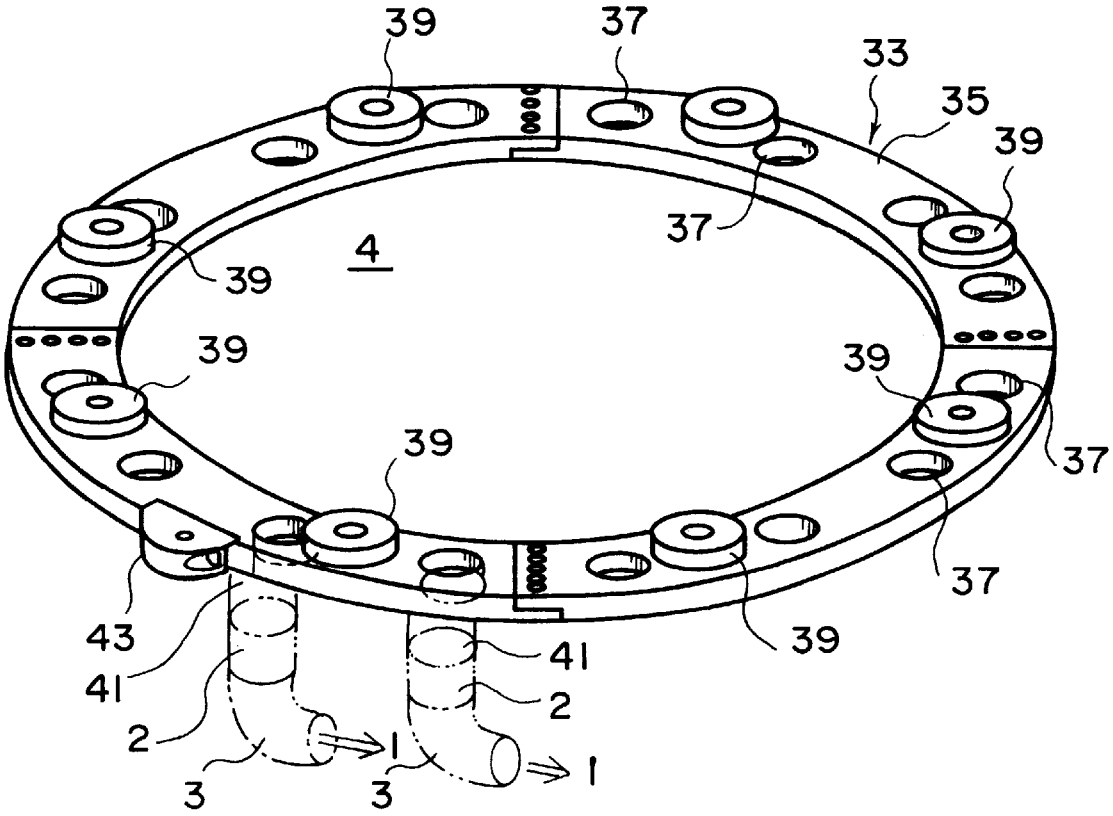
FIG. 2 is a perspective view of the components comprising the flat sliding ring in the device described above for controlling the volume of air bypassed.

FIG. 1 is a side view of the essential parts of a bypass air control device for controlling the volume of air bypassed which is a preferred embodiment of this invention. FIG. 2 is a perspective view of the components comprising the flat sliding ring in the device for controlling the volume of air bypassed.

Figure 3:
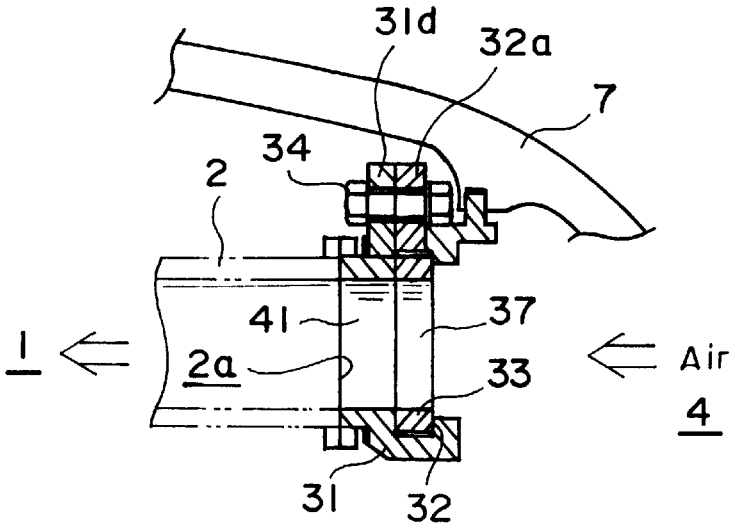
FIG. 3 is a partial cross section of FIGS. 1 and 2, which shows how the flat sliding ring and the bypass channels meet and how the ring is fixed to the casing.

FIG. 3 is a partial cross section of FIGS. 1 and 2. It shows how the flat sliding ring and the bypass channels meet and how the ring is attached to the casing.

Figure 4:
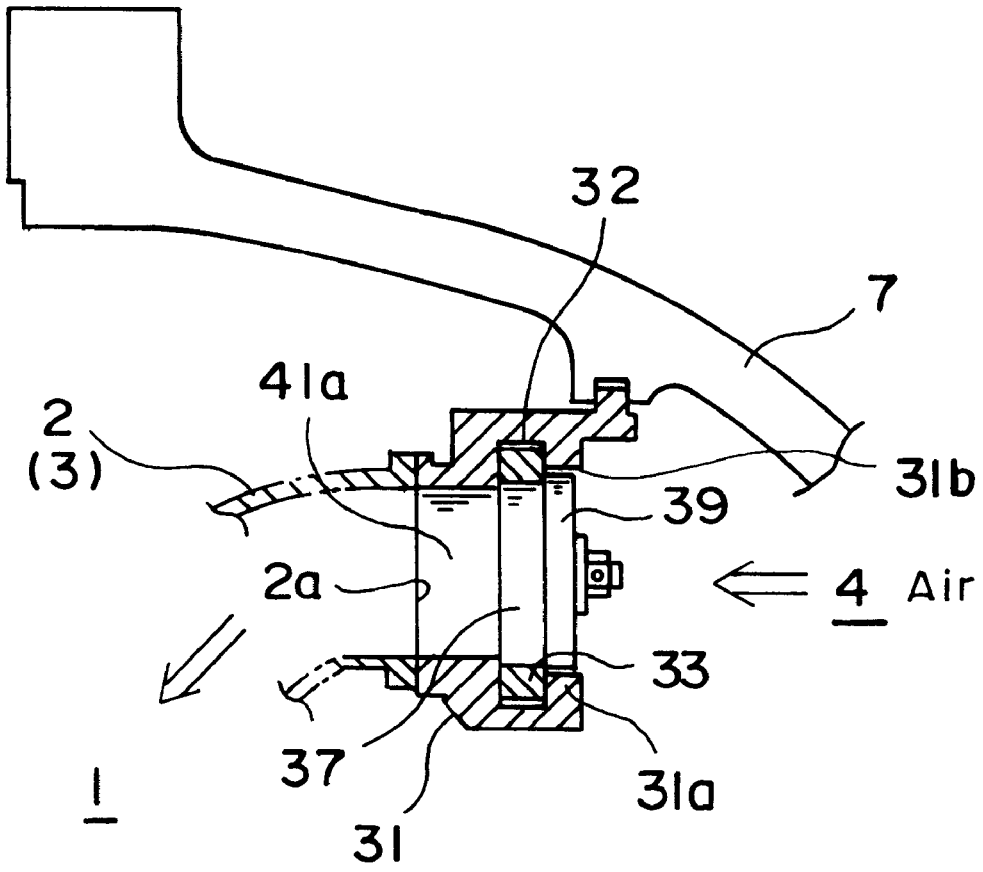
FIG. 4 is a partial cross section of FIGS. 1 and 2, which shows how the sliding rollers on top of the flat sliding ring engage with the valve supporting base.

FIG. 4 is a partial cross section of FIGS. 1 and 2, which shows how the sliding rollers on top of the flat sliding ring engage with the valve supporting base.

Figure 7:
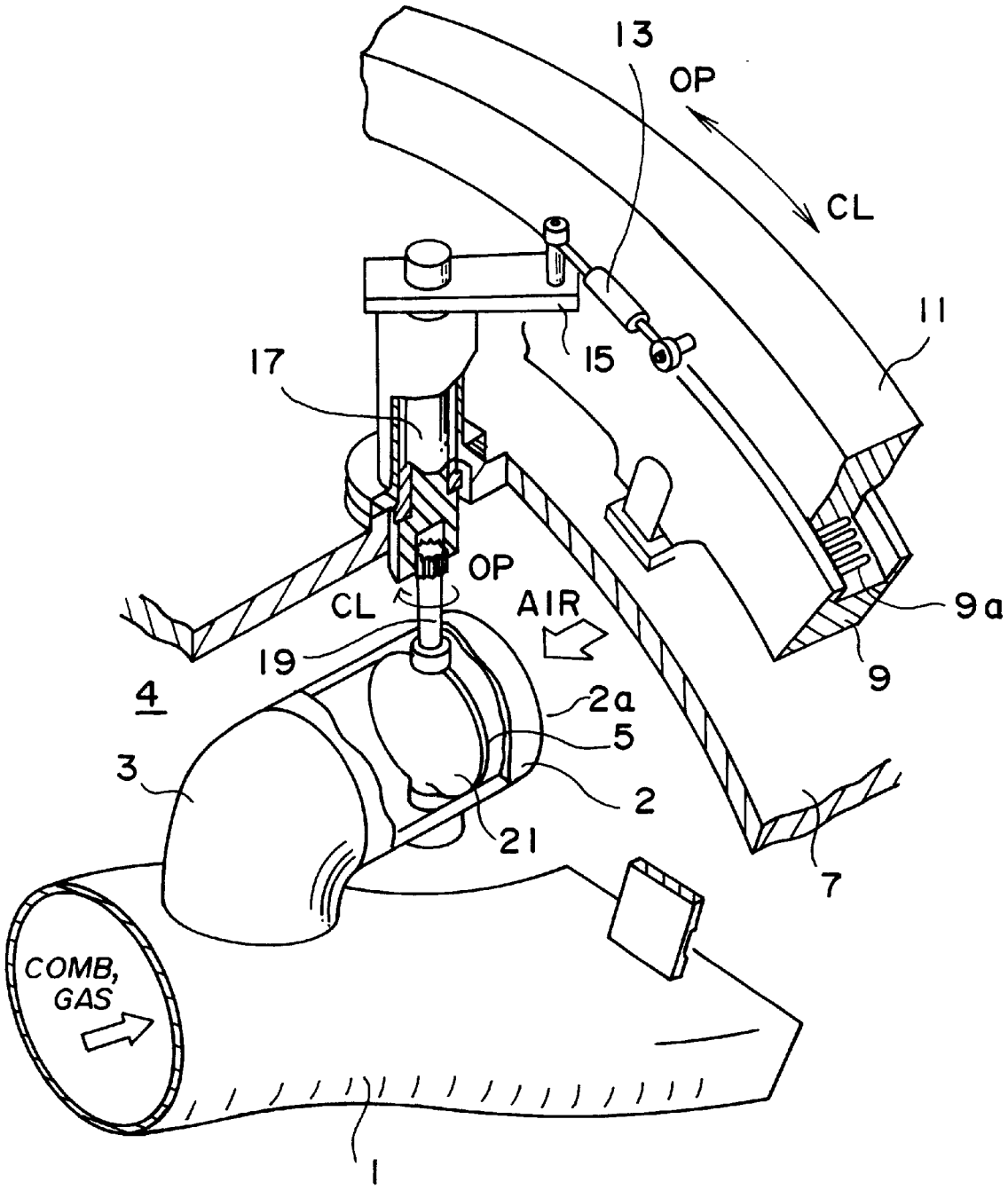
FIG. 7 is a cut-away perspective view of a prior art device for controlling the volume of air bypassed.

In these drawings, casing 7 of the combustion engine is cylindrical. Pressurized air from a compressor (not shown) is conducted to its interior, where it pressurizes space 4. Sixteen bypass channels 2/3 (see FIG. 2), each of which comprises an elbow pipe 3 and a bypass pipe 2, are arranged around the circular periphery of the casing 7 at regular intervals so that their openings 2*a* face space 4 of casing 7 at a pitch of 22.5°. As can be seen in FIG. 7, the elbow pipes 3 which constitute bypass channels 2/3 are connected to the side part of tail pipes 1. The pressurized air from the openings 2*a* of the bypass channels can be bypassed into the tail pipes 1.

Valve mechanism 30, the ring-shaped valve for controlling the volume of air bypassed, runs along a hypothetical circle which connects the openings 2*a* of all the channels in such a way that it can seal all the openings. The openings 2*a* of the sixteen bypass channels are arranged at regular intervals around the periphery of the casing 7. Valve mechanism 30 comprises a flat sliding ring 33, a large-diameter ring-shaped sliding panel which corresponds to the hypothetical circle connecting the openings 2*a* of the sixteen bypass channels, and a ring supporting base (holder of the ring) 31, which supports the flat sliding ring 33 so that it can freely slide in the circumferential direction.

Flat sliding ring 33, which is shown in FIG. 2, consists of ring-shaped panel 35, in which are opened, at an angular pitch of 22.5°, which is the same pitch as openings 2*a* of bypass channels 2/3, a number of openings 37 equal to the number of the openings 2*a;* and eight guide rollers 39, which are placed on the upper surface of the ring-shaped panel 35 at a pitch of 45° and supported in such a way that they are free to rotate.

There may be either 1×16 bypass channels 2/3 corresponding to the number of tailpipes, or 2×16 bypass channels 2/3; in the latter case, the number of the openings 37 likewise corresponds to the number of bypass channels 2/3.

As should be clear from FIGS. 1 and 4, the guide rollers 39 are of approximately the same diameter as the groove between the inner wall 31*a* of ring supporting base 31 and its outer wall 31*b*. The guide rollers 39 are in frictional contact with either inner wall 31*a* or outer wall 31*b* as they rotate. In this way the ring-shaped panel 35 can rotate concentrically to cylindrical casing 7 with a high degree of accuracy.

Ring supporting base 31, which supports the sliding ring 33 so that it is free to rotate, has the form of a round valve supporting base. As is made clear by FIG. 3, it is fixed to casing 7 by flange 32*a* on its outer periphery.

As can be seen in FIG. 3, ring supporting base 31 has a dual construction so that it can enclose ring-shaped panel 35. Flanges 31*d* and 32*a* on either segment of the ring supporting base are joined by bolt 34 to form a single entity.

As can be seen in FIG. 1, a portion of the outer wall of the ring supporting base 31 is cut away, and the outer periphery of sliding ring 33 is exposed in this cut-away portion 31*c*.

Mounting seat 43 is mounted to the exposed outer edge of sliding ring 33. As can be seen in FIG. 1, adjustment link 50 is connected to the ring through the mounting seat 43 and clevis 51.

Adjustment link 50 extends to the outer surface of casing 7. At this surface it is mounted through clevis 67 to crank lever 69, which is supported by bracket 71 in such a way that it is free to pivot. The crank lever 69 is connected to actuator 81 through connecting rod 77.

When actuator 81 travels back and forth, crank lever 69 is caused to pivot by connecting rod 77. This pivoting motion is conveyed through clevis 67, causing connecting rod 59 of adjustment link 50 to travel back and forth. This motion is conveyed through clevis 51 and mounting seat 43, causing sliding ring 33 to rotate back and forth through a given angle.

The range of rotation of sliding ring 33 should be such that when the ring is rotated through a given angle, the openings 37 in the ring move from a position in which they completely overlap openings 2*a* of the bypass channels 2/3 to a position in which they are completely separated from those openings. In this way the area 36 of the opening of each of the bypass channels 2/3 can be controlled accurately.

Adjustment link 50 is supported on casing 7 in an airtight fashion.

Figure 5:
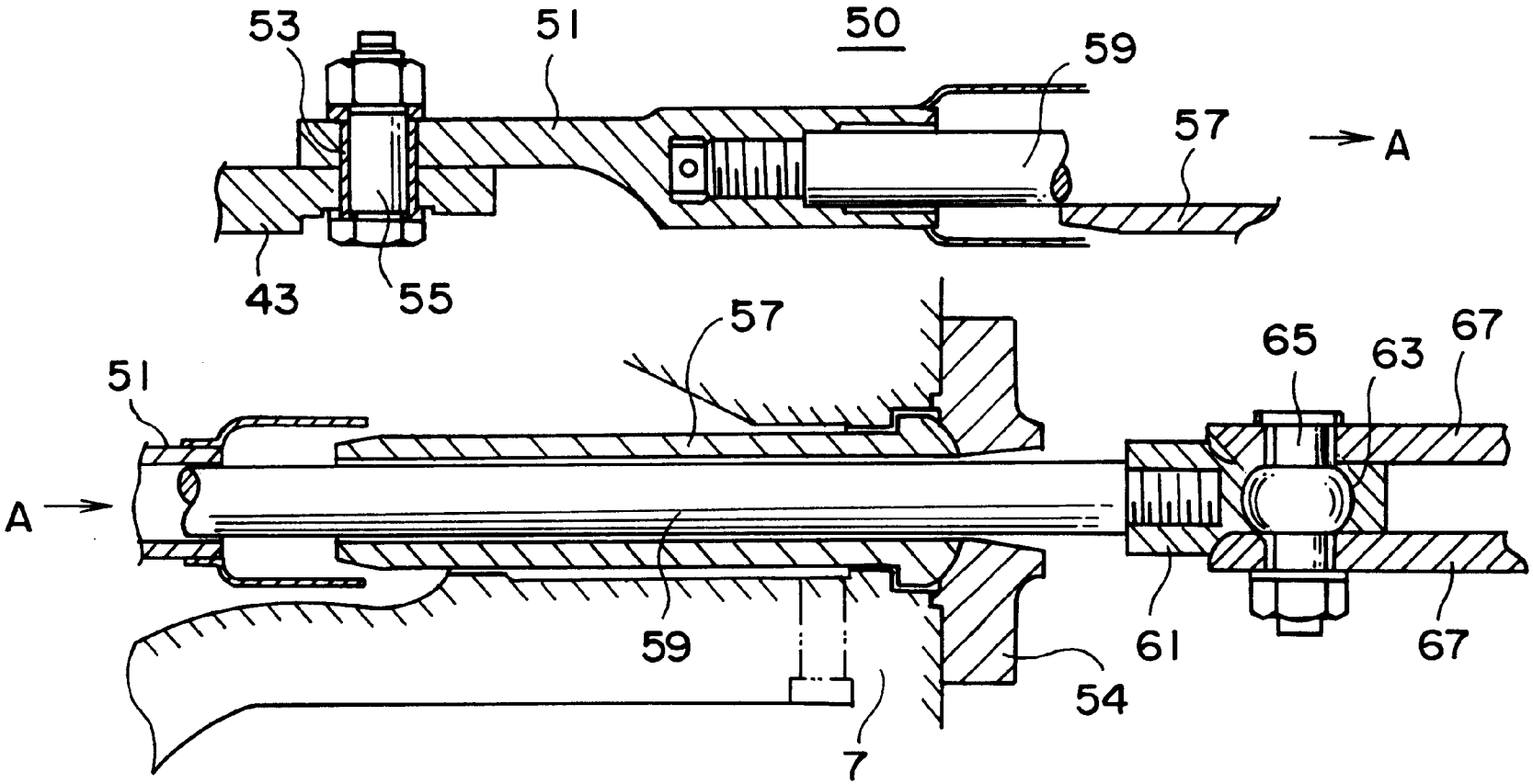
FIG. 5 is a cross section of the side on which the valve operating mechanism is mounted to the device for controlling the volume of air bypassed, which shows the major structural components of the valve operating mechanism.
Figure 6:
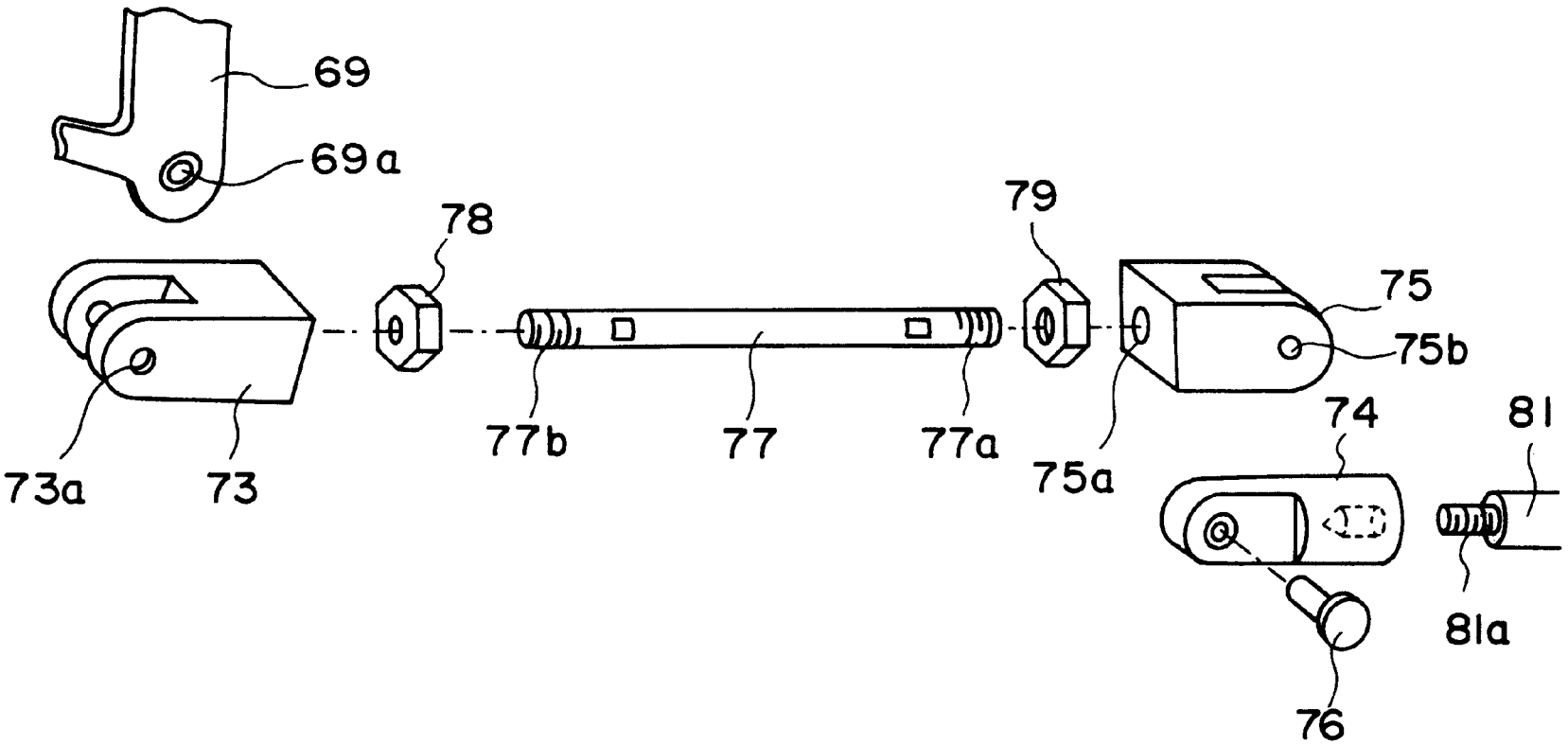
FIG. 6 is an exploded perspective view of the other side of the valve operating mechanism of FIG. 5.

FIG. 5 shows the area around the adjustment link where the flat sliding ring of the valve operating mechanism is mounted. This flat sliding ring is the main component of the device for controlling the volume of air bypassed. FIG. 6 shows the area around the connecting rod on the other side of the valve operating mechanism in FIG. 5.

In FIG. 5, one end of clevis 51 is attached through connecting pin 55 and bushing 53 to mounting seat 43 in such a way that the clevis is free to pivot. The other end of clevis 51 is screwed onto one end of connecting rod 59. Connecting rod 59 is inserted into support sleeve 57, which is fixed to casing 7. Rod 59 projects beyond casing 7, and its exposed end is screwed into Joint 61.

The portion of support sleeve 57 which comes in contact with mounting panel 54 on the outer surface of casing 7 is machined into a spherical surface to form a tight seal and prevent any air leaks.

Joint 61, which is screwed to the end of connecting rod 59, is connected through spherical bearing 63 and connecting pin 65 to one end of clevis 67. The other end of clevis 67, as can be seen in FIG. 1, is connected to one of the free ends of triangular crank lever 69.

As is shown in FIG. 1, the base of crank lever 69 is supported by bracket 71 in such a way that it is free to pivot. Bracket 71 is fixed to the outer surface of casing (i.e., combustion chamber housing) 7. As can be seen in FIG. 6, the other free end of crank lever 69 is connected through clevis 73 and connecting rod 77 to actuator 81. It is connected to the clevis by a pin which is inserted through holes 69*a* and 73*a*. Connecting rod 77 has such clevises (73 and 75) on either end.

When a pin 76 is inserted through holes 69*a* and 73*a* (or 75*b*) in clevis 73 (or 75), bracket 71 or actuator mount 74 is supported in such a way that it is free to pivot on clevis 73 (or 75).

The end 77*b* of rod 77 which connects to clevis 73 has a left-handed thread; the end 77*a* which connects to clevis 75 has a right-handed thread. These work together with hole 75*a* of clevis 75 and the hole (not shown) in clevis 73 to form a turnbuckle.

Rotating connecting rod 77, then, will adjust the distance between clevises 73 and 75 to produce the appropriate connection between link 50 and actuator 81.

Once the connection between rod 77 and clevises 73 and 75 has been adjusted, lock nut 78 is tightened onto the left-handed screw and lock nut 79 onto the right-handed screw.

The amount of play in the connection between clevis 73 and crank lever 69 and that between clevis 75 and actuator 81 can be increased through the use of spherical bearings and pins like the bearing 63 and pin 65.

In this embodiment, a link 50 assembled like that shown in FIG. 1 is used to cause flat sliding ring 33 to travel back and forth in the circumferential direction when actuator 81 moves back and forth. In this way the amount of overlap 36 between openings 37 in the ring and openings 2*a* of bypass channels 2/3 can be controlled. By adjusting the area of the overlapping openings, the volume of air that is bypassed can be adjusted.

Ring-shaped panel 35 of flat sliding ring 33 engages frictionally in groove 32 of ring supporting base 31. A specified degree of frictional resistance operates during its rotation to mitigate vibration.

The changes occasioned by different rates of thermal expansion among the components around link 50 will be absorbed by the universal joints comprised of connecting pins and spherical bearings.

Effects of the Invention

With the invention described above, vibration due to combustion in a combustion chamber will not translate into vibration of structural components of a control valve. Combustion vibration will not result in self-induced vibration, and the abrasion of components which experience friction will be mitigated. The opening and closing of the bypass can be controlled reliably and stably.

Furthermore, with this invention, any thermal expansion or assembly error experienced by connectors such as the links between the control valve in the bypass channel and the valve adjustment mechanisms on the outer surface of the casing can easily be absorbed.

Other effects may also be achieved.

What is claimed is:

1. A bypass air control device used in a gas turbine combustor in which a number of combustion chambers with tail pipes are arranged in a pressurized space of a combustor casing, which bypasses a volume of compressed air in said pressurized space fed from a compressor, by diverting the compressed air into the tail pipes via bypass valves and bypass air channels, comprising:

a flat sliding ring, which intersects a plurality of the bypass air channels and has a plurality of openings corresponding to openings of said bypass air channels, and a valve operating mechanism to control an opening/closing degree of the openings of said bypass air channels by rotating said flat sliding ring back and forth in a circumferential direction.

2. A bypass air control device used in a gas turbine combustor according to claim 1, wherein said valve operating mechanism comprises said flat sliding ring having a number of said openings which corresponds to the number of said bypass air channels, and a ring supporting base which supports said flat sliding ring in such a way that said flat sliding ring can slide freely in the circumferential direction, and one side of said openings of said flat sliding ring opens to said pressurized space to conduct a portion of said compressed air into said openings of said bypass channels.

3. A bypass air control device used in a gas turbine combustor according to claim 1, wherein said valve operating mechanism includes a connecting rod connected at one end to said flat sliding ring through a pivot support and another end extending to an outer surface of the combustor casing so as to rotate said flat sliding ring back and forth through a certain angle when an actuator moves the connecting rod back and forth, whereby the openings in said flat sliding ring rotate to coincide with or move away from said openings of said bypass air channels when said valve operating mechanism rotates said flat sliding ring through the angle in order to control an overlapped area of said openings of both said flat sliding ring and said bypass air channels.

* * * * *